United States Patent [19]

Huso

[11] 4,205,946

[45] Jun. 3, 1980

[54] SLURRY PUMP SYSTEM - METHOD FOR PREVENTING SLURRY FROM ENTERING WATER PUMPING FLUIDS

[76] Inventor: Maurice A. Huso, 5310 Las Lomas St., Long Beach, Calif. 90815

[21] Appl. No.: 721,888

[22] Filed: Sep. 9, 1976

[51] Int. Cl.[2] ..... F04B 35/00; F04B 15/02

[52] U.S. Cl. ..... 417/53; 417/392; 92/86.5

[58] Field of Search ..... 417/53, 92–104, 417/392; 92/86.5

[56] References Cited

U.S. PATENT DOCUMENTS

| | | | |
|---|---|---|---|
| 2,797,972 | 7/1957 | Martin | 92/244 |
| 2,956,511 | 10/1960 | Morehead | 417/415 |
| 3,146,940 | 9/1964 | McCory et al. | 92/86.5 |
| 3,306,216 | 2/1967 | Warman | 417/92 |
| 3,556,682 | 1/1971 | Sakamoto et al. | 417/102 |
| 3,630,638 | 12/1971 | Huso | 417/53 |
| 3,749,529 | 7/1973 | Cornolsen | 92/86.5 |
| 3,853,245 | 12/1974 | Branch et al. | 417/392 |
| 3,938,912 | 2/1976 | Sakamoto et al. | 417/392 |
| 3,994,626 | 11/1976 | Stock | 92/86.5 |

FOREIGN PATENT DOCUMENTS

| | | | |
|---|---|---|---|
| 1193908 | 6/1965 | Fed. Rep. of Germany | 417/392 |

*Primary Examiner*—William L. Freeh

*Attorney, Agent, or Firm*—Lyon & Lyon

[57] ABSTRACT

A pumping system comprising a chamber having a movable separator positioned therein, means for forcing the separator towards a first fluid on one side of the separator when a second fluid on the other side of the separator is maintained at a greater pressure than the first fluid.

7 Claims, 1 Drawing Figure

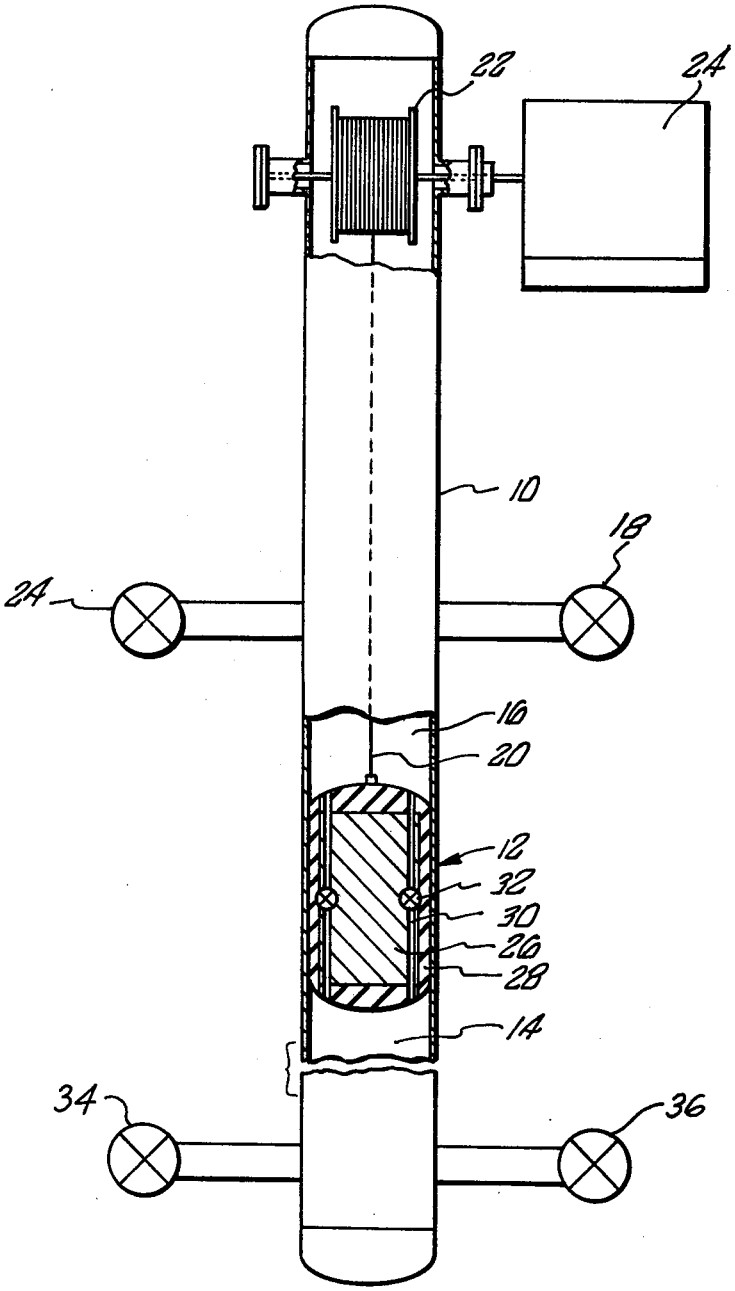
22
24
10
18
24
16
20
12
32
30
26
28
14
34
36

SLURRY PUMP SYSTEM - METHOD FOR PREVENTING SLURRY FROM ENTERING WATER PUMPING FLUIDS

BACKGROUND OF THE INVENTION

The present invention relates to a pumping system which includes a driving fluid and a driver fluid and has particular application to the pipeline transportation of solids suspended in a liquid medium to form a slurry.

The long distance pipeline transportation of such solids as coal, iron ore, sulfur, limestone and wood chips like the long distance pipeline transportation of petroleum and petroleum products offers certain advantages not common to other modes of transportation. Moreover, it is considered to be at least potentially more convenient and more economical than the more conventional means of transportation, i.e., rail or truck.

In long distance pipelining of slurries it is necessary that the pumping system employed develop a high pressure head and maintain a substantially constant velocity of slurry flow in the pipeline. In the past the most common method of transporting slurries through pipelines over long distances has involved the use of reciprocating-type pumps. However, these pumps have very high initial costs, high maintenance costs and develop substantial pulsations in the pipeline due to the non-uniform velocity of the slurry therein imparted to the slurry by the pumps. Therefore, attempts were made to employ centrifugal pumps such as used in petroleum pipelining. But such attempts proved unsuccessful where high pressure and high volume was required because the abrasive action of the slurry caused severe damage to the centrifugal pumps.

The disadvantages associated with the previous slurry pumping systems were overcome by my previous invention described in U.S. Pat. No. 3,630,638 which issued on Dec. 28, 1971, and the disclosure of which is incorporated herein by reference. This patent discloses in part a pumping system comprising one or more centrifugal pumps and a series of chambers. The chambers are adapted to be filled with a driving fluid which comprises a recirculating liquid and a driver fluid which comprises a slurry. The slurry enters the chambers at a relatively low pressure and exits at a relatively high pressure. The recirculating liquid is pressurized by the centrifugal pump or pumps and functions to apply the pressure to the slurry and this pressure forces the slurry to exit from the chambers. The two fluids, i.e., the recirculating liquid and the slurry, are separated in the chambers by movable separators which reciprocate in the chamber when the slurry enters and exits. The recirculating liquid, rather than the slurry, passes through the centrifugal pump or pumps and, because it is substantially free of any solids, abrasive action on the pump is avoided.

However, it has been found that in certain instances, i.e., when the seal between the movable separator and the chamber is worn, small amounts of the slurry may leak past the separator into the recirculating liquid. This occurs as a result of the pressure differential across the separator when a slurry entering a chamber is at a higher pressure than the recirculating liquid exiting the chamber. This leakage results in a small amount of slurry mixing with the recirculating liquid and, thus, adds solids thereto which pass through the centrifugal pumps. If this continues over an extended period of time, damage can result in the pumps.

It is therefore a primary object of this present invention to provide a pumping system having a driving fluid and a driver fluid wherein means are provided to avoid admixing of the driver fluid with the driving fluid.

These and other objects and advantages are obtained by providing in a chamber having a movable separator positioned therein, means for forcing the separator towards a first fluid on one side of the separator when a second fluid on the other side of the separator is maintained at a greater pressure than the first fluid. The means preferably pulls the separator towards the first fluid with a force which is in addition to any force caused by the pressure differential between this first and second fluids. This insures that the pressure on the side of the separator adjacent the first fluid will be greater than the pressure on the other side of the separator, thereby avoiding leakage of the second fluid past the separator into the first fluid.

BRIEF DESCRIPTION OF THE DRAWING

A more thorough disclosure of the objects and advantages of the present invention is presented in the detailed description which follows and from the accompanying drawing which is a cross-sectional view of a system according to the present invention.

DETAILED DESCRIPTION OF THE INVENTION

The present invention relates to a pumping system which includes a first or driving fluid and a second or driver fluid separated in a pressurizing chamber by a movable separator with means to avoid admixing of the second fluid with the first fluid and, in a preferred embodiment includes a slurry pumping system where admixing of slurry with a liquid which circulates through one or more centrifugal pumps is avoided. The slurry pumping system comprises a centrifugal pump and a series of elongated pressurizing chambers. The chambers are adapted to be filled up with low-pressure slurry and then empty a high-pressure slurry. A recirculating liquid which has been pressurized by one or more centrifugal pumps functions to apply the pressure on the slurry to force the slurry out from the chamber. The pumping system is provided with a separator which is slideably positioned within the chamber and isolates the recirculating liquid from the slurry. Means are provided for forcing the separator towards the recirculating liquid when the slurry is being introduced into the chamber. This causes the pressure on the recirculating liquid side of the separator to be greater than the pressure on the slurry side of the separator thereby preventing leakage of the slurry past the separator into the recirculating liquid.

Preferably, the means comprises a cable and reel disposed on the recirculating side of the chamber. The cable is attached to the separator and is wound onto the reel to move the separator towards the side of the chamber. The reel is preferably provided with an adjustable torque motor or a motor and an adjustable magnetic slip clutch which functions to apply a constant tension on the cable. As the slurry is being introduced into the chamber, the separator is pulled towards the recirculating liquid, thereby increasing and pressure on the liquid side and avoiding leakage of the slurry past the separator into the liquid.

Referring to the drawing, there is shown the preferred embodiment of the present invention. The slurry pumping system is comprised generally of an elongated pressurizing chamber 10 and a slideable separator 12 which divides the chamber into a slurry side 14 and a recirculating liquid side 16. During operation, low-pressure slurry is introduced into the chamber on the slurry side of the chamber, thereby urging the separator 12 towards the recirculating liquid side of the chamber. The system includes a cable 20 and a reel 22. The cable and reel are preferably comprised of a non-corroding metal such as stainless steel. The reel is preferably connected to an adjustable torque motor 24 or a motor driving an adjustable magnetic slip clutch, or other such means for providing an adjustable continuous torque to the reel.

To introduce the slurry into chamber 10, liquid outlet valve 18 and slurry inlet valve 34 are opened. The separator which is located at the far end of side 14 of the chamber is moved towards the other end of the chamber by the incoming slurry which in part forces the recirculating liquid out of the chamber through valve 18. During this operation, the motor 24 rotates reel 22 to pull separator 12 towards end 16 of the chamber. The tension functions to overcome the friction between the separator and the wall of the chamber and apply a positive pressure on the recirculating liquid side of the separator, thereby avoiding leakage of the slurry past the separator. Preferably, a tension is applied which is greater than that required to overcome the separator/-wall friction such that the additional tension causes the first fluid to always be at a greater pressure than the second fluid. For example, if the slurry is being introduced into chamber 10 at a pressure of about 25 p.s.i., and the separator/wall friction is equivalent 2 p.s.i. the torque to the reel would be adjusted to apply a tension on cable 20 equivalent to 2.5 p.s.i. Thus, the pressure on the recirculating liquid side of the separator would be about 25.5 p.s.i., whereas the pressure on the other side of the separator would be only about 25 p.s.i. Thus, any leakage past the separator would be leakage of recirculating liquid into the slurry rather than slurry into the recirculating liquid.

When chamber 10 is filled with slurry, valve 18 and the slurry inlet valve are closed and liquid inlet valve 24 and the slurry outlet valve 36 are opened. The high pressure recirculating liquid is introduced into chamber 10, thereby propelling separator 12 towards the far end of side 14 of chamber 10 and forcing the slurry out of the chamber through the slurry outlet valve 36. During this phase, the pressure on the recirculating liquid side of the separator is greater than the pressure on the slurry side and any leakage will again be leakage of the recirculating liquid past the separator into the slurry.

The separator is preferably provided with means to enable one-way fluid communication through the separator. The separator 12 is preferably comprised of body 26 which is integrally formed with sleeve 28. The body preferably consists of a noncorroding metal or elastomeric material and the sleeve preferably consists of only an elastomeric material such as rubber. The means to enable one-way fluid communication are preferably formed in body 26 as elongated ports 30. The ports are preferably circumferentially disposed around the edge of body 26 and provided with check valves 32 which enable passage of recirculating liquid into the slurry side of the chamber but prevent the passage of slurry into the recirculating liquid side of the chamber. The check valves may be adjusted to enable a predetermined amount of recirculation liquid to pass through the ports into the other side of the separator. The liquid functions to flush slurry from the walls of the chamber ahead of, and around, the separator, thereby facilitating prevention of slurry from leaking past the separator into the recirculating liquid.

Thus, the present invention adds further improvement to the slurry pumping system of my previous invention, U.S. Pat. No. 3,630,638. That is, it provides for the avoidance of abrasive wear of the pumps employed in the system while accommodating centrifugal pumps and non-pulsating flow of the slurry through the pipeline.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

I claim:

1. A pumping system comprising:

a pressurizing walled chamber adapted to receive a first fluid and a second fluid;

a separator positioned slideably within said chamber and sealably connected to the walls thereof, said separator adapted to separate said fluids and reciprocate in said chamber as a result of a pressure differential between said fluids, said separator movable against said second fluid as a result of pressure differential between said fluids; and a reel and cable in addition to said fluid pressure to force said separator against said first fluid and in the direction of movement caused by the higher pressure of said second fluid to thereby avoid leakage of said second fluid between said walls and said separator into said first fluid.

2. The unit of claim 7 wherein said reel is rotated by a motor having means to provide an adjustable continuous torque to said reel.

3. In a slurry pumping system comprising at least one pressurizing chamber having a slurry inlet and outlet and a liquid inlet and outlet, said chamber having a separator slideably positioned therein to separate a liquid side of said chamber from a slurry side of said chamber, means for (i) increasing the pressure of the liquid on the liquid side of said chamber to a pressure higher than the pressure of the slurry on the slurry side of said chamber for discharging slurry from said chamber and for (ii) decreasing the pressure of the liquid on the liquid side of said chamber to a pressure lower than the pressure of the slurry on the slurry side of said chamber, the improvement comprising:

means for pulling the separator against the liquid when the slurry is entering into the chamber so that the liquid is at a higher pressure than the slurry on the slurry side of the chamber to avoid leakage of slurry around said separator and admixing with said liquid and including means to enable one-way fluid communication through the separator.

4. The unit of claim 3 wherein said means to enable one-way fluid communication comprises a plurality of ports having check valves positioned therein.

5. The unit of claim 4 wherein said ports are circumferentially disposed around said separator.

6. A pumping method to pump through a pipeline a liquid having contained therein suspended solids comprising the steps of:

providing a pressurizing walled chamber adapted to receive a driving liquid pressurized by a centrifugal pump and the liquid containing solids, the chamber having a separator positioned slideably within, said separator being adapted to separate said liquids and to move through said chamber as a result of pressure differential between said liquids; and applying a force to said separator to move said separator in one direction against said driving liquid, said direction being in the direction of movement tended to be caused by the pressure of the liquid containing solids, thereby avoiding leakage of said liquid containing solids between said walls and said separator into said driving liquid.

7. In a slurry pumping system comprising at least one pressurizing chamber having a slurry inlet and outlet and a liquid inlet and outlet, said chamber having a separator slideably positioned therein to separate the liquid side of said chamber from the slurry side of said chamber, slurry discharged from said chamber by increasing the pressure of the liquid on the liquid side of said chamber, the improvement comprising:

a reel and cable for pulling the separator against the liquid when the slurry is entering into the chamber and the liquid is exiting the chamber to avoid leakage of slurry around said separator and admixing with said liquid.

* * * * *